United States Patent [19]

Fink et al.

[11] Patent Number: 4,963,103

[45] Date of Patent: Oct. 16, 1990

[54] ELECTRICAL CONNECTOR WITH IMPROVED CONNECTOR POSITION ASSURANCE DEVICE

[75] Inventors: Randy L. Fink, Warren; Bruce J. Serbin, Austintown, both of Ohio

[73] Assignee: General Motors Corporation, Detroit, Mich.

[21] Appl. No.: 424,753

[22] Filed: Oct. 20, 1989

[51] Int. Cl.[5] ..... H01R 13/627

[52] U.S. Cl. ..... 439/352; 439/358

[58] Field of Search ..... 439/301, 304, 350–358, 439/489

[56] References Cited

U.S. PATENT DOCUMENTS

| | | | |
|---|---|---|---|
| 4,311,355 | 1/1982 | Plyler et al. . | |
| 4,370,013 | 1/1983 | Niitsu et al. | 339/82 |
| 4,634,204 | 1/1987 | Detter et al. | 339/91 R |
| 4,708,413 | 11/1987 | Schroeder | 439/358 |
| 4,746,306 | 5/1988 | Yurtin et al. | 439/357 |

OTHER PUBLICATIONS

ITT Cannon SLE Series Catalog dated 1986.

*Primary Examiner*—Gary F. Paumen

*Attorney, Agent, or Firm*—F. J. Fodale

[57] ABSTRACT

An electrical connector comprises a thermoplastic connector body, a plurality of electrical terminals which are attached to a plurality of insulated conductor wires, an elastomeric seal, a thermoplastic backshell, a connector position assurance device and a thermoplastic cap. The elastomeric seal provides both conductor wire and interface seals. The backshell includes movable clam shells which gather the conductor wires in a bundle in the closed position. The connector position assurance device cooperates with one of the clam shells and a release lever to insure that the electrical connector is properly latched to a mating connector.

5 Claims, 4 Drawing Sheets

ELECTRICAL CONNECTOR WITH IMPROVED CONNECTOR POSITION ASSURANCE DEVICE

BACKGROUND OF THE INVENTION

This invention relates generally to electrical connectors and more specifically to electrical connectors which have a connector position assurance device to assure that mating electrical connectors are properly mated and locked together.

Electrical connectors which have such devices are already known in the prior art. See for instance U.S. Pat. No. 4,746,306 granted to John A. Yurtin et al, May 24, 1988; U.S. Pat. No. 4,708,413 granted to Diane M. Schroeder, Nov. 24, 1987; U.S. Pat. No. 4,634,204 granted to Gary C. Detter et al, Jan. 6, 1987; and U.S. Pat. No. 4,370,013 granted to Mitsugi Niitsu et al, Jan. 25, 1983.

Such devices are also disclosed in pending patent applications which are assigned to General Motors Corporation, such as U.S. patent application Ser. No. 223,339 filed by John R. Metzger July 25, 1988; U.S. patent application Ser. No. 380,571 filed by Ken Cope et al, July 17, 1989 and U.S. patent application Ser. No. 403,955 filed by Robert G. Plyler et al Sept. 7, 1989.

It is also known to provide electrical connectors with a "pump handle" lock arm, that is, a lock arm which is hinged or pivotally connected to the electrical connector midway between its ends. In such an arrangement, the forward end of the pump handle lock arm acts as the lock arm while the rearward end acts as a release handle. When the release handle is depressed, the lock arm is pivoted out of engagement with a cooperating lock nib of the mating connector. Electrical connectors having a connector position assurance device which operates in conjunction with a pump handle lock arm are disclosed in the U.S. Pat. No. 4,708,413 granted to Diane M. Schroeder and the pending U.S. patent application Ser. No. 403,955 filed by Robert G. Plyler et al which are identified above.

SUMMARY OF THE INVENTION

The object of this invention is to provide an improved electrical connector which has a pump handle lock arm and a connector position assurance device which operates in conjunction with a release handle of the pump handle lock arm.

A feature of the invention is that the connector position assurance device is engaged with the release handle of a pump handle lock arm in the longitudinal direction.

Another feature of the invention is that improved connector position assurance device is engaged with a release handle of a pump handle lock arm in a manner which does not require flexure of the release handle.

Another feature of the invention is that the connector position assurance device and the electrical connector are structured to guide the connector position assurance device longitudinally into engagement with the release handle of the pump handle lock arm.

Another feature of the invention is that the connector position assurance device and the release handle are shaped to insure that the connector position assurance device cannot be engaged if the pump handle lock arm is not properly engaged.

Yet another feature of the invention is that the engaged connector position assurance device prevents depression of the release handle and consequent inadvertent disconnection of the electrical connector.

Still yet another feature of the invention is that the connector position device may be used in conjunction with a movable clam shell of an electrical connector which has hinged clam shells which form an end bell for gathering insulated conductor wires.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
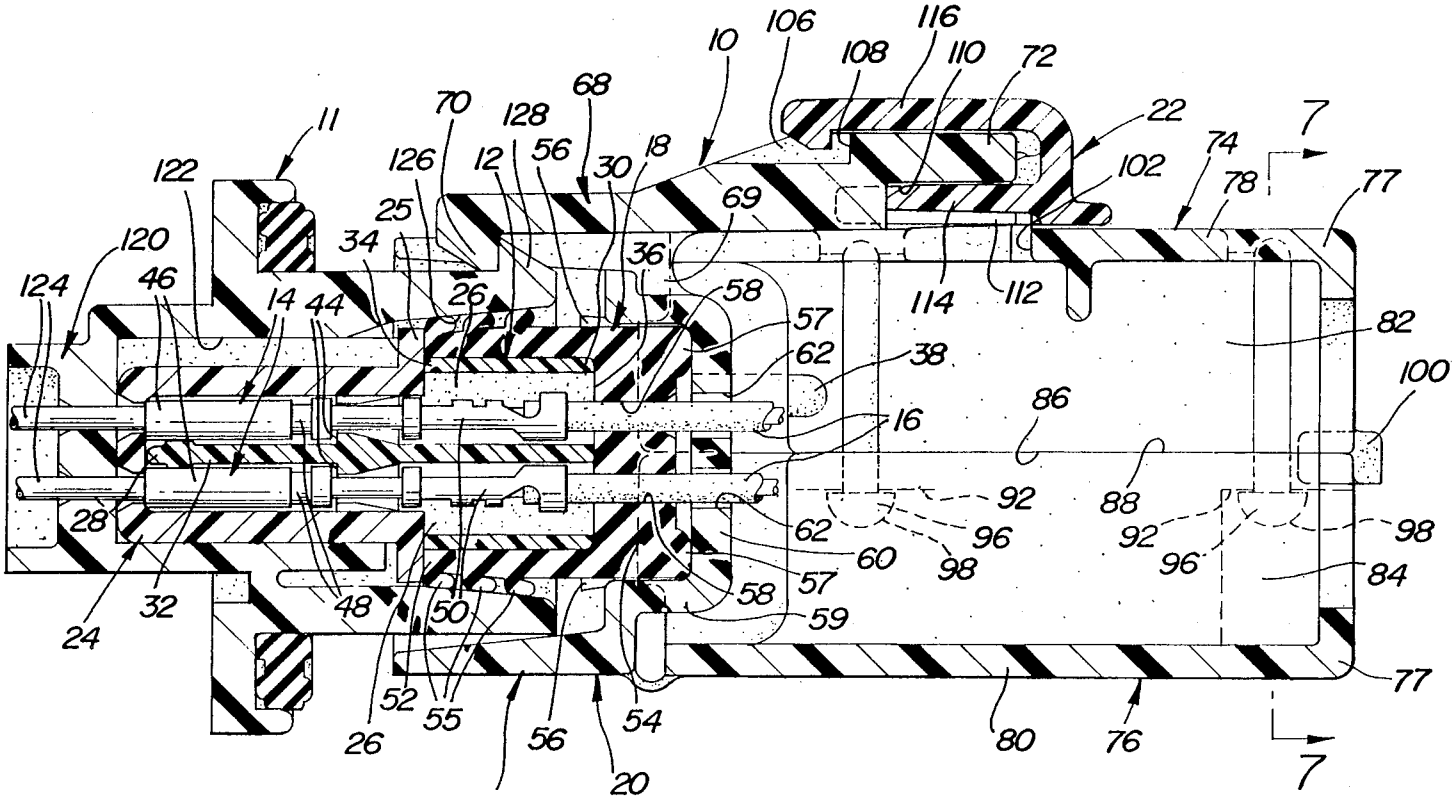
FIG. 1 is a longitudinal sectional view of an electrical connector in accordance with the invention mated to another electrical connector.

Referring now to the drawing and more particularly to FIG. 1, an electrical connector 10 in accordance with this invention is shown mated to another electrical connector 11.

The electrical connector 10 of the invention comprises a thermoplastic connector body 12, a plurality of electrical terminals 14 which are attached to a plurality of insulated conductor wires 16, an elastomeric seal 18, a thermoplastic backshell 20, a connector position assurance device 22 and a thermoplastic cap 24.

The connector body 12 has a plurality of terminal cavities 26 which extend axially through the connector body from a forward contact end 28 to a rearward conductor end 30. The connector body 12 has a nose portion 32 of reduced height at the contact end 28 and an enlarged rearward portion 34 at the conductor end 30 which has lock posts 38 which project from a rearward face 36 of the enlarged rearward portion 34.

The terminal cavities 26 have rearward portions which are of oval cross section and elongated in the vertical direction as shown in FIG. 1. The nose portion 32 comprises a plurality of ribs defining a channel 40 at the forward portion of each terminal cavity. Each terminal cavity 26 has a catch 42 at the forward end of its channel to hold the terminal 14 down in the channel and a wedge shaped lock shoulder 44 near the rearward end of its channel for retaining the terminal 14 in the terminal cavity and preventing it from being pulled out the rearward conductor end 30.

One of the terminals 14 is disposed in each terminal cavity 26 Each terminal 14 has a tubular receptacle 46 at its forward end, a circumferential retention groove 48 intermediate its ends and conventional crimp wings 50 at its rearward end which attach the terminal to its associated insulated conductor wire 16.

Figure 3:
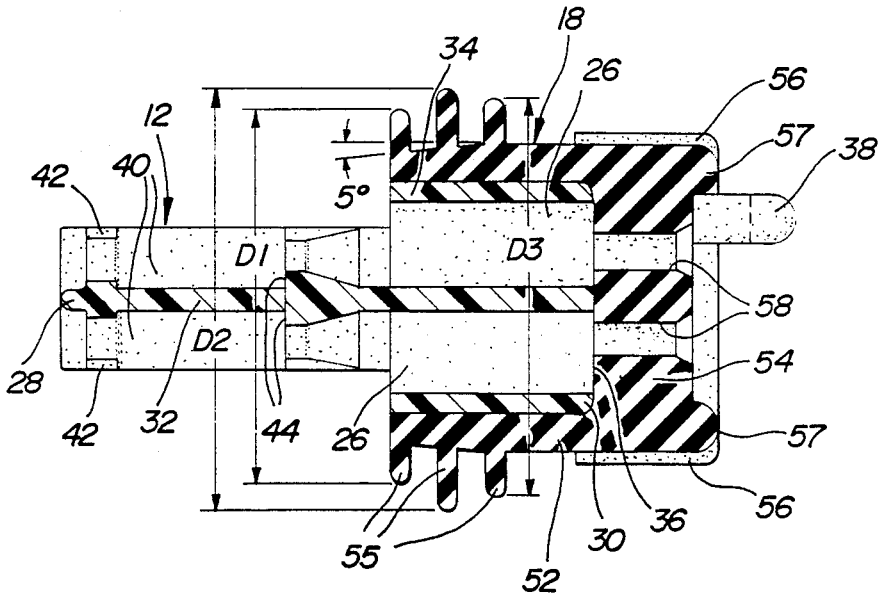
FIG. 3 is a section taken substantially along the line 3—3 of FIG. 2 looking in the direction of the arrows.

The elastomeric seal 18, which is preferably made of a silicone rubber, is fitted over the rearward portion 34 at the conductor end of the connector body 12. The elastomeric seal 18 comprises an annular wall 52 and a back wall 54. The annular wall 52 which fits snugly on the rearward portion 34 of the connector body 12 has a forward portion which has a taper of about 5 degrees. This forward portion has a plurality of circumferential sealing lips 55 which are in a modified tapered pattern. The modified tapered pattern of the circumferential sealing lips 55 is such that the tips of the end lips lie in an imaginary line or surface which also has a taper of about 5 degrees while the tip of the middle lip lies outwardly thereof when the sealing lips 55 are in their free undeflected state as shown in FIG. 3. Thus the forward sealing lip has the smallest diameter D1 while the middle sealing lip has the largest diameter D2 and the rear sealing lip has the larger diameter D3. The sealing lips 55 are adapted to provide an interface seal when the connector body 12 is plugged into a mating connector body and the sealing lips 55 are deflected as shown in FIG. 1. The enlarged diameter D2 of the middle sealing lip increases sealing integrity as will be explained hereinafter.

Figure 2:
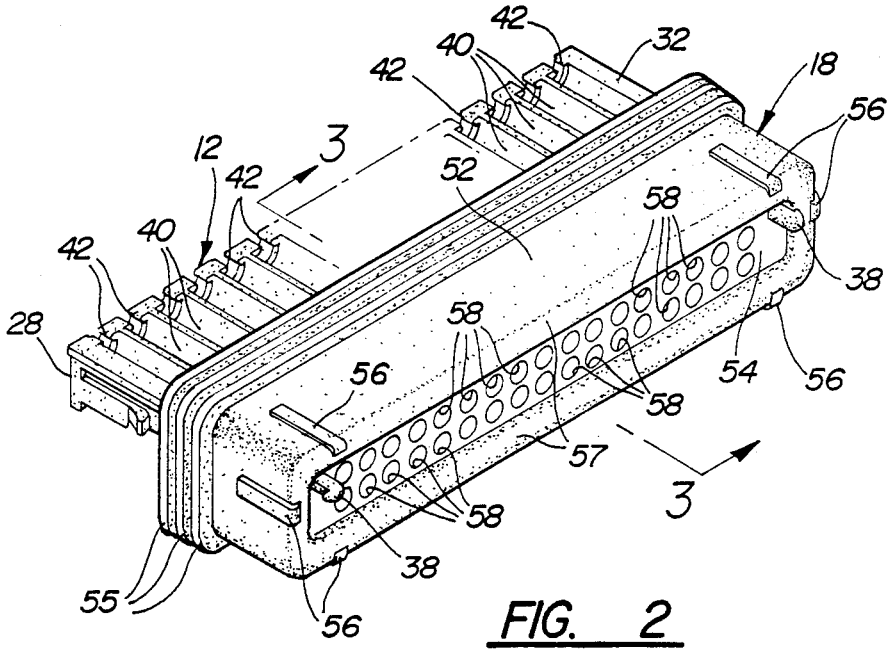
FIG. 2 is a perspective view of a subassembly comprising a connector body and an elastomeric seal of the electrical connector in accordance with the invention which is shown in FIG. 1.

The rearward portion of the annular wall 52 has a plurality of longitudinal ribs 56 which are arrayed in a triangular arrangement near each lateral end of the elastomeric seal 18 as best shown in FIG. 2. The function of the longitudinal ribs 56 is to stabilize the connection of the connector body 12, the elastomeric seal 18 and the backshell 20 in the transverse or radial direction.

The back wall 54 of the elastomeric seal 18 has a circumferential rib 57 at its outer margin and a plurality of apertures 58 which are disposed inwardly of the circumferential rib 57. The function of the circumferential rib 57 is to stabilize the connection of the connector body 12, the elastomeric seal 18 and the backshell 20 in the longitudinal direction. The plurality of apertures extend through the back wall 54 and are aligned with the terminal cavities 26 and the lock posts 38. The apertures 58 are sized so that the back wall 54 seals around the insulated conductor wires 16 and the lock posts 38 which project through the apertures 58 when elastomeric seal 18 is mounted on the connector body 12 and the terminals 14 are inserted into the terminal cavities 26. Thus the elastomeric seal 18 also seals the conductor end of the connector body 12 as shown in FIG. 1.

The backshell 20 is fitted over the elastomeric seal 18 and attached to the rearward conductor end of the connector body 12 by the lock posts 38 in order to retain the elastomeric seal 18 in place. The backshell 20 has an annular wall 59 which engages the longitudinal ribs 56 of the elastomeric seal 18 and a back wall 60 which engages the circumferential rib 57 of the elastomeric seal 18 so as to bias the elastomeric seal 18 snugly into engagement with the rear portion 34 and end face 30 of the connector body 12. This stabilizes the connection between these three parts in the transverse or radial and longitudinal directions as indicated above.

The back wall 60 of the elastomeric seal 18 has a plurality of guide holes 62 which are aligned with the apertures of the elastomeric seal 18 and the terminal cavities 26 of the connector body 12. The guide holes 62 are used to guide the terminals 14 into the terminal cavities 26 through the apertures of the elastomeric seal 18. The guide holes 62 are larger than the apertures so that the terminals 14 are freely inserted through the guide holes.

Figure 6:
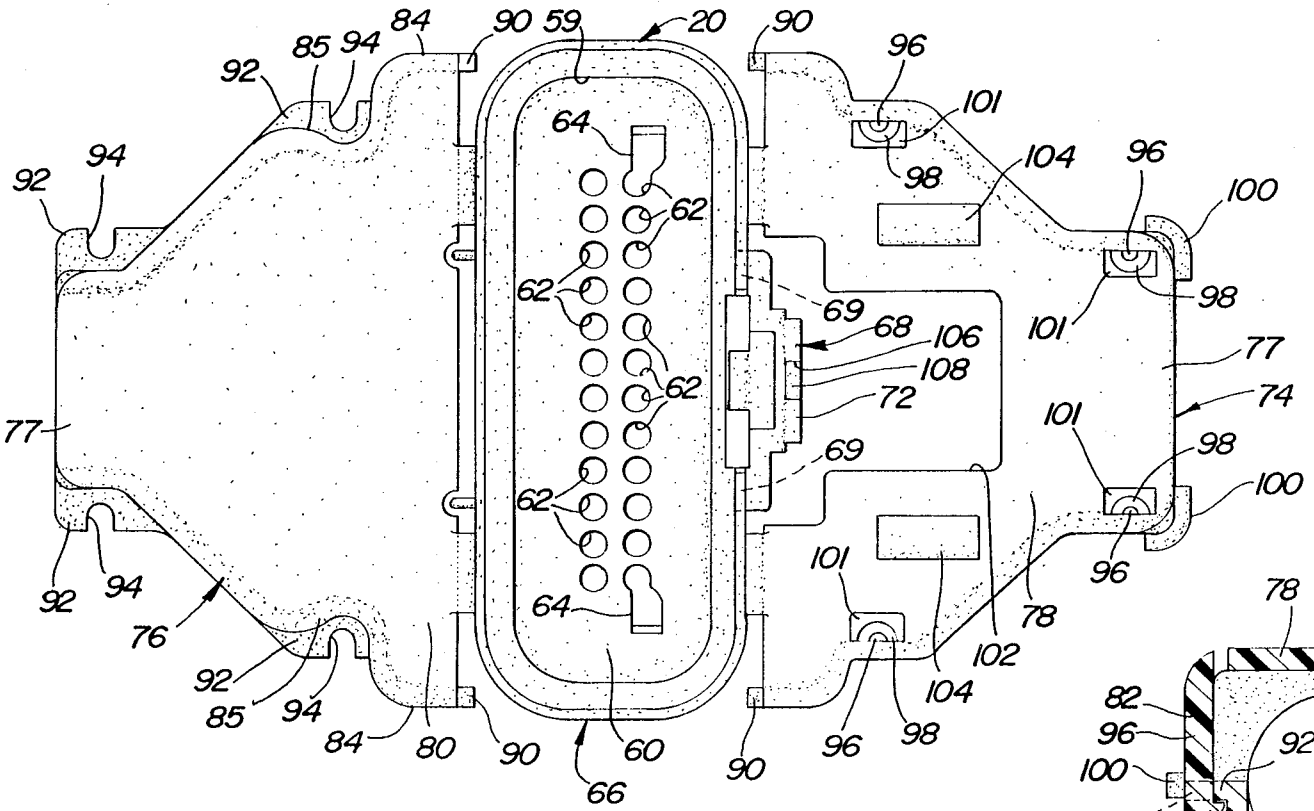
FIG. 6 is a front view of the backshell which is shown in FIGS. 4 and 5 illustrating the backshell in an open position.

The back wall 60 of the backshell also has two latch holes 64 which receive and cooperate with the lock posts 38 to secure the backshell 20 to the connector body 12. The two latch holes 64 are merged with two of the guide holes 62 as shown in FIG. 6.

The backshell 20 also has a forward enlarged shroud 66 which is spaced radially outwardly of the annular wall 59 and the circumferential sealing lips 55 and which extends forwardly of the elastomeric seal 18 to protect the elastomeric seal 18 during handling.

The backshell 20 further includes a pump handle lock arm which is attached to the annular wall 59 of the backshell 20 by integral hinges 69 to form a forward lock arm 68 and a rearward release handle 72. The lock arm 68 has a catch 70 which is forward of the hinges 69 and the rearward release handle 72 pivots the forward lock arm 68 and the catch 70 outwardly about the integral hinges 69 when the rearward release handle is depressed.

The backshell 20 further includes an end bell for gathering the insulated conductors 16 into a bundle which comprises upper and lower clam shells 74 and 76 which are integrally hinged to the backshell. The clam shells 74 and 76 move between an open position providing access to the back wall 60 of the backshell 20 which is shown in FIG. 6 and a closed position shown in FIGS. 1, 4, 5 and 7. In the closed position, the ends 77 of the clam shells 74 and 76 cooperatively provide a collar which embraces the conductor wires 16.

The upper and lower clam shells 74, 76 have planar walls 78, 80 which are integrally hinged to the back wall of the backshell shroud 66 and generally perpendicular side walls 82, 84 which are integrally attached at the edges of the respective planar walls 78, 80. The planar walls 78, 80 are parallel to each other and the generally perpendicular side walls 82, 84 have planar mating faces 86, 88 which abut each other when the upper and lower clam shells 74, 76 are in the closed position which is shown in FIGS. 1, 4, 5 and 7. The inner ends of the side walls 82, 84 also have stops 90 which engage the rear wall of the shroud 66 to prevent the clam shells 74, 76 from pivoting past the closed position.

The means for locking the upper and lower clam shells 74, 76 together in the closed position will now be described.

The lower clam shell 76 has a plurality of ledges 92 which are outward of its side wall 84. These ledges 92 are near the mating face 88 of the side wall 84 and have slots 94 which open away from the side wall.

The upper clam shell 74 has a plurality of cooperating lock pins 96 which extend beyond the mating face 86 of its side wall 82 in an outlined confined fashion. That is, the lock pins 96 do not extend past the side wall 82 in the laterally outward direction to guard against the formation of catch or snag points as is clear from FIGS. 4, 5, 6 and 7. The ledges 92 are also outlined confined for the same reason. That is, even though the ledges 92 are outward of the side wall 84, the ledges do not extend past the side wall 82 in the laterally outward direction. It should also be noted that the side wall 84 has recesses 85 near the hinged end of the clam shell 76. These recesses stiffen the clam shell 76 and accommodate the rearward pair of ledges 92 and tips of the cooperating lock pins 96 as a further guard against the formation of catch or snag points.

Figure 5:
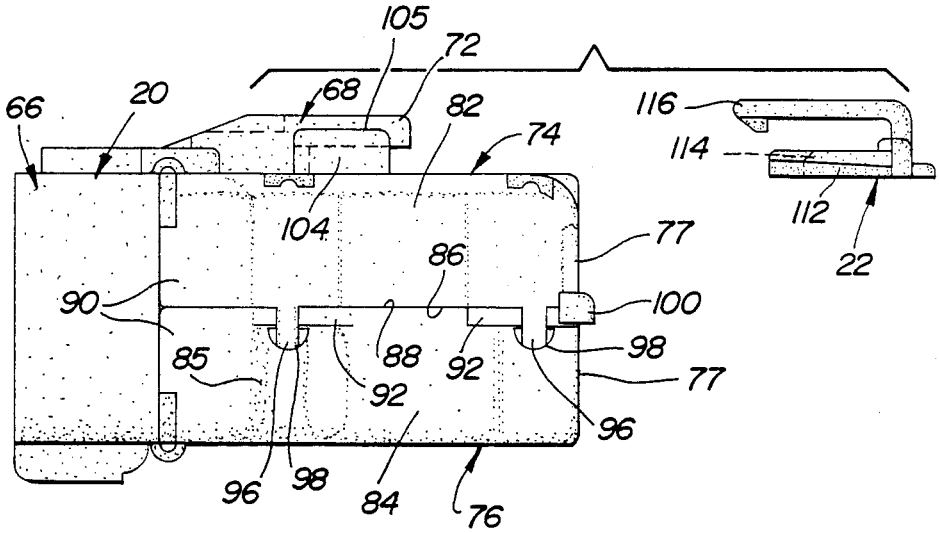
FIG. 5 is an exploded side view of the backshell and the connector position assurance device which is shown in FIG. 4.

The tips of the lock pins 96 project through the slots 94 and into the space below the ledges 92 when the clam shells 74, 76 are closed. These lock pins 96 have inwardly projecting heads 98 which snap past the ledges 92 and engage the lower surfaces of the ledges 92 near the slots 94 to lock the clam shells 74, 76 together in the closed position as best shown in FIGS. 5 and 7.

The plurality of ledges 92 and cooperating lock pins 96 are arranged in two opposing pairs near the hinged and free ends respectively so that the upper and lower clam shells 74, 76 are fastened securely in the lateral as well as the vertical direction. As mentioned above, the stops 90 engage the rear wall of the shroud 66 to stabilize and locate the upper and lower clam shells 74, 76 solidly in the vertical direction. The upper clam shell 74 also has a pair of curved flanges 100 at its free end which engage side surfaces of the opposed ledges 92 at the free end of the lower clam shell 76 to further stabilize and fix the clam shells 74, 76 firmly relative to each other in the lateral direction.

Figure 4:
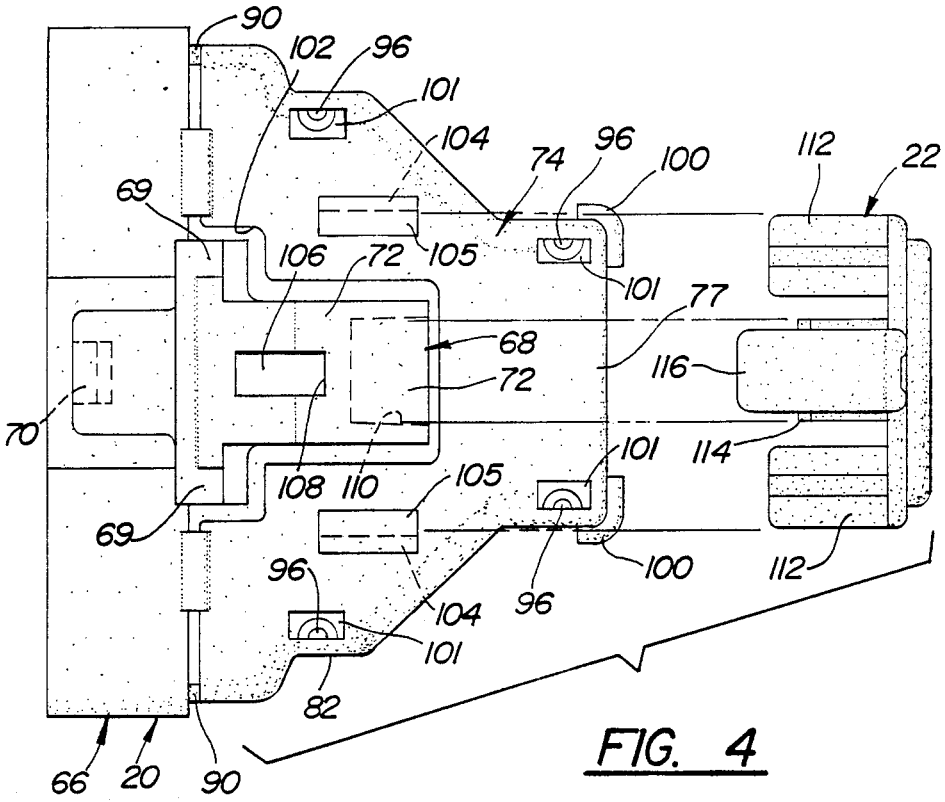
FIG. 4 is an exploded top view of a backshell and a connector position assurance device of the electrical connector in accordance with the invention which is shown in FIG. 1.
Figure 7:
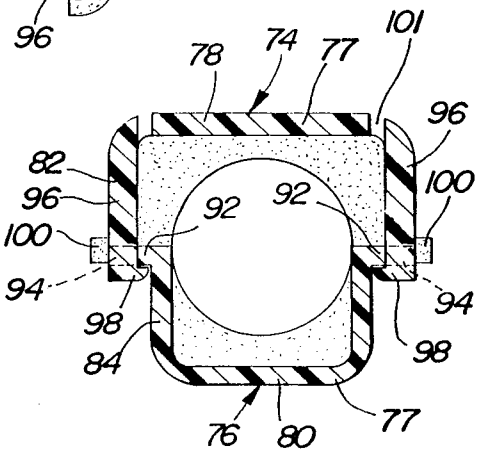
FIG. 7 is a section taken substantially along the line 7—7 of FIG. 1 looking in the direction of the arrows.

The planar wall 78 of the upper clam shell 74 has apertures 101 which facilitate molding of the lock pins 96 with the inwardly directed heads 100 as best shown in FIGS. 4, 6 and 7. The planar wall 78 also has a large T-shaped slot 102 which fits around the hinged portion and release handle 72 of the lock arm 68. The upper clam shell 74 also has laterally spaced rails 104 which are integrally connected to the planar wall 78 on either side of the T-shaped slot 102. The rails 104 have inwardly directed flanges 105 on each side of the slot 102 (and lock arm 68 when the upper clam shell 74 is in the closed position).

The laterally spaced rails 104 of upper clam shell 74 receive the connector position assurance device 22 when the clam shells 74 and 76 are in the closed position and the lock arm 68 is correctly positioned to lock the electrical connector 10 to its mating electrical connector 11 as shown in FIG. 1. The connector position assurance device 22 also prevents depression of the release handle 72 and the unlocking of the lock arm after the electrical connector 10 is properly connected to the mating electrical connector 11.

In order to cooperate with the connector position assurance device, the release handle 72 has a slot 106 in an upper surface which provides a lock shoulder 108 and a longitudinal groove 110 in a lower surface which faces the planar wall 78 of the clam shell 74 when it is in the closed position. The longitudinal groove 110 extends to a free end of the release handle 72.

The connector position assurance device 22 has a pair of laterally spaced runners 112 which are sized to fit between the pair of rails 104 and slide beneath the respective flanges 105 in the longitudinal direction. The device 22 further includes a tongue 114 which is disposed between the laterally spaced runners 112 and which is sized to fit in the groove 110 of the release handle 72 when the lock arm 68 is disposed in a properly locked position as shown in FIG. 1.

The connector position assurance device 22 further includes a lock arm 116 which cooperates with the lock shoulder 108 of the release handle 72 to lock the device 22 in the connector position assurance position which is shown in FIG. 1.

The cap 24 is fitted over the nose portion 32 of the connector body 12 and retained in place by latch arms 118 at the forward end of the connector body 12.

The electrical connector 10 is assembled in the following manner. The elastomeric seal 18 is fitted over the conductor end of the connector body 12 as shown in FIGS. 1, 2 and 3. This elastomeric seal 18 provides both a conductor seal and an interface seal as explained below. The backshell 20 is then fitted over the elastomeric seal 18 and secured in place by the lock posts 38 which snap through the lock holes 64 and engage the outer surface of the back wall 60.

When the backshell 20 is secured in place, the annular wall 59 compresses the longitudinal ribs 56 of the elastomeric seal 18 to stabilize the elastomeric seal in the transverse or radial direction. The back wall 60 of the backshell 20 also compresses the circumferential rib 57 biasing the back wall 54 of the elastomeric seal 18 against the end face 36 of the connector body 12 to stabilize the elastomeric seal 18 in the longitudinal direction.

The clam shells 74, 76 are in the open position shown in FIG. 7 and the terminals 14 are then plugged into the connector body 12 through the guide holes 62 in the exposed back wall of the backshell 20. The terminals 14 fit freely through the guide holes which guide the terminals 26 into the undersized apertures in the back wall of the elastomeric seal 18. As the terminals 14 are plugged in through the undersized apertures, the elastomeric seal 18 is firmly held in place through compression of the longitudinal and circumferential ribs 56, 57 by the annular and back walls 59, 60 of the backshell 20.

When the front end of the terminal 14 reaches the channel 40 of the terminal cavity 26, terminal is cammed upwardly over the wedge shaped lock 44 until the terminal is fully inserted into the terminal cavity 26. The front end of the terminal 14 is then snapped down into the channel 40 past the catch 42 which retains the front end of the terminal 14 in the channel 40. At this time the wedge lock shoulder 44 enters the circumferential retention groove 48 to retain the terminal 14 in the longitudinal direction.

When all the terminals 14 are inserted into their respective terminal cavities 26, the cap 24 is mounted and retained on the nose portion 32 of the connector body 12 as shown in FIG. 1. The cap 24 has a rearward flange 25 which protects the front of the elastomeric seal 18. The clam shells 74, 76 are then closed and solidly retained in the closed position by the cooperating slotted ledges 92 and headed lock pins 96. As indicated above the solid retention and location of the closed clam shells 74, 76 is enhanced by the stops 90 and the curved flanges 100.

In use the electrical connector 10 is plugged into a mating electrical connector such as the header connector 11 which is shown in FIG. 1. The header connector 11 comprises an insulator body 120 which has a socket 122 and which is typically attached to a printed circuit board (not shown). The header connector 11 further comprises a plurality of pin terminals 124 which have one end soldered or otherwise suitably electrically connected to conductors of the printed circuit board and the other end projecting into the socket 122 for engagement with a mating terminal. The socket 122 has an internal sealing surface 126 which tapers outwardly toward the open end of the socket and an external lock projection 128 which cooperates with the catch 70 of the electrical connector 10.

When the electrical connector 10 is mated to the header connector 11, the force required to compress the sealing lips 55 is applied more gradually because the sealing lips 55 and the sealing surface 126 are both tapered. The enlarged diameter D2 of the middle sealing lip 55 increases sealing integrity by accommodating warpage in the sealing surface 126 of the socket 122. On the other hand the enlarged diameter D2 does not increase the force required to compress the sealing lips 55 to any appreciable extent.

When the electrical connector 10 is completely mated to the header connector 11, the catch 70 of the lock arm 68 engages the lock projection 126 to lock the connectors together. The connector position assurance device 22 is then inserted into the flanged rails 104 of the closed upper claim shell 74 and slid into the locked position shown in FIG. 1 where the tongue 114 is disposed in the longitudinal groove 110 of the release handle 72. The locked position of the connector position assurance device 22 assures that the electrical connectors 10 and 11 are properly locked together and also prevents depression of the release handle 72 and the consequent unintentional disconnection.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In an electrical connector having a pump handle lock arm which is hinged to a connector body of the electrical connector midway between its ends to provide a forward lock arm for locking the electrical connector to a mating electrical connector and a rearward release handle which is depressible to pivot the lock arm out of engagement with a cooperating lock nib of a mating electrical connector, and a connector position assurance device for assuring proper engagement of the lock arm and preventing depression of the release handle, the improvement comprising:

the release handle having an upper surface and a lower surface which faces a generally planar surface of the connector body, the upper surface having a lock shoulder and the lower surface having a longitudinal groove which extends to a free end of the release handle, the connector position assurance device including a tongue which is sized to fit in the groove of the release handle when the lock arm is disposed in a properly locked position, and the connector position assurance device further including a lock arm which cooperates with the lock shoulder of the release handle to lock the connector position assurance device in position.

2. The electrical connector as defined in claim 1 wherein the improvement further comprises:

the generally planar surface of the connector body having a pair of laterally spaced rails which are disposed on either side of the release handle for guiding the connector position assurance device into engagement with the release handle of the lock arm.

3. The electrical connector as defined in claim 2 wherein the improvement further comprises:

the pair of laterally spaced rails having inwardly facing flanges, and the connector position assurance device having a pair of laterally spaced runners which are sized to fit between the pair of rails and slide beneath the respective flanges.

4. In an electrical connector having a pump handle lock arm which is hinged to a connector body of the electrical connector midway between its ends to provide a forward lock arm for locking the electrical connector to a mating electrical connector and a rearward release handle which is depressible to pivot the lock arm out of engagement with a cooperating lock nib of a mating electrical connector and a connector position assurance device for assuring proper engagement of the lock arm and prevent depression of the release handle, the improvement comprising:

the release handle having an upper surface and a lower surface which faces a generally planar surface of the connector body, the upper surface having a lock shoulder and the lower surface having a longitudinal groove which extends to a free end of the release handle, the generally planar surface of the connector body having a pair of laterally spaced rails which are disposed on either side of the release handle and which have inwardly facing flanges, and the connector position assurance device having a pair of laterally spaced runners which are sized to fit between the pair of rails and slide beneath the respective flanges, the connector position assurance device including a tongue which is disposed between the runners and which is sized to fit in the groove of the release handle when the lock arm Is disposed in a properly locked position, and the connector position assurance device further including a lock arm which cooperates with the lock shoulder of the release handle to lock the connector position assurance device in position.

5. In an electrical connector having a connector body which has a plurality of terminal cavities extending axially through the connector body from a forward contact end to a rearward conductor end, a plurality of terminals which are attached to insulated electrical conductors and which are disposed in the respective terminal cavities with the insulated electrical conductors extending out of the rearward conductor end of the connector body, an end bell for gathering the insulated electrical conductors into a bundle which has upper and lower clam shells which are hingedly mounted on the connector body for movement between an open position providing access to the terminal cavities and a closed position providing a gathering collar for the insulated electrical conductors, and a lock arm for locking the electrical connector to a mating electrical connector which is hinged to the connector body to provide a depressible release handle which overlies one of the clam shells when it is in the closed position, and a connector position assurance device for assuring the lock arm is properly engaged and preventing depression of the release handle, the improvement comprising:

the release handle having an upper surface and a lower surface which faces a generally planar surface of the one clam shell when the one clam shell is in the closed position, the upper surface having a lock shoulder and the lower surface having a longitudinal groove which extends to a free end of the handle, the generally planar surface of the one clam shell having a pair of laterally spaced rails which are disposed on either side of the release handle and which have inwardly facing flanges, and the connector position assurance device having a pair of laterally spaced runners which are sized to fit between the pair of rails and slide beneath the respective flanges, the connector position assurance device further including a tongue which is disposed between the runners and which is sized to fit in the groove of the release handle when the lock arm is disposed in a properly locked position, and the connector position assurance device further including a lock arm which cooperates with the lock shoulder of the release handle to lock the connector position assurance device in position.

* * * * *